US011813871B2

(12) United States Patent
Palumbo

(10) Patent No.: US 11,813,871 B2
(45) Date of Patent: Nov. 14, 2023

(54) DIGITAL PRINTING DEVICE WITH ENHANCED NOZZLE PLATE'S CLEANING SYSTEM

(71) Applicant: NEOS S.r.l., Fiorano Modenese (IT)

(72) Inventor: Vincenzo Palumbo, Fiorano Modenese (IT)

(73) Assignee: NEOS S.R.L., Fiorano Modenese (IT)

( * ) Notice: Subject to any disclaimer, the term of this patent is extended or adjusted under 35 U.S.C. 154(b) by 150 days.

(21) Appl. No.: 17/436,388

(22) PCT Filed: Mar. 5, 2020

(86) PCT No.: PCT/EP2020/055826
§ 371 (c)(1),
(2) Date: Sep. 3, 2021

(87) PCT Pub. No.: WO2020/178382
PCT Pub. Date: Sep. 10, 2020

(65) Prior Publication Data

US 2022/0126586 A1 Apr. 28, 2022

(30) Foreign Application Priority Data

Mar. 5, 2019 (EP) ..... 19425009

(51) Int. Cl.
*B41J 2/165* (2006.01)

(52) U.S. Cl.
CPC ..... *B41J 2/16585* (2013.01); *B41J 2/16511* (2013.01); *B41J 2/16532* (2013.01); *B41J 2/16547* (2013.01)

(58) Field of Classification Search
CPC ..... B41J 2/16585; B41J 2/16511; B41J 2/16532; B41J 2/16547
See application file for complete search history.

(56) References Cited

U.S. PATENT DOCUMENTS

| | | | | |
|---|---|---|---|---|
| 9,227,412 | B1 | 1/2016 | Liu | |
| 9,233,541 | B1 * | 1/2016 | Cyr | B41J 2/16523 |
| 2012/0299996 | A1 | 11/2012 | Kano | |
| 2018/0264826 | A1 | 9/2018 | Karppinen | |

FOREIGN PATENT DOCUMENTS

WO WO-2020083466 A1 * 4/2020 ..... B41J 2/16511

OTHER PUBLICATIONS

Written Opinion of the International Searching Authority issued in connection with PCT/EP2020/055826.
International Search Report issued in connection with PCT/EP2020/055826.

* cited by examiner

*Primary Examiner* — Sharon Polk
(74) *Attorney, Agent, or Firm* — Akerman LLP

(57) ABSTRACT

A digital printing device, comprising a nozzle plates' cleaning bar (9) equipped with a plurality of cleaning heads (22) supported in a floating manner by a bar body (23), so as to adapt their own height to the one of an overlying printing module comprising a specific nozzle plate corresponding to the cleaning head (22).

14 Claims, 5 Drawing Sheets

DIGITAL PRINTING DEVICE WITH ENHANCED NOZZLE PLATE'S CLEANING SYSTEM

CROSS-REFERENCE TO RELATED APPLICATIONS

This application is a national phase of PCT/EP2020/055826, filed Mar. 5, 2020, and claims priority to EP 19425009.8, filed Mar. 5, 2019, the entire contents of both of which are hereby incorporated by reference.

FIELD OF APPLICATION

The present invention relates to a digital printing device, in particular of the type comprising an automatic cleaning system of the nozzle plate of the print heads.

In particular, the invention can find a useful application in several technological fields where industrial printing is required on surfaces of various type, for example in the printing on paper, corrugated cardboard, cardboard, plastic film, thermoplastic sheets; namely in the printing of labels, packaging, signs or even ceramic coatings, glass materials, wood or metal supports.

BACKGROUND ART

Industrial printing devices generally comprise one or more printing modules equipped with print heads, intended to deposit ink drops onto a printing medium that travels below the printing modules themselves.

The above printing devices can provide a cleaning system of the nozzles of the heads, that allows this maintenance operation to be performed automatically. These cleaning systems can use a cleaning bar, that is translated below the nozzle plate in the context of a dedicated cleaning operation. This operation can in particular provide for a purge action of the head obtained by imposing a positive pressure in the ink circuit thereof.

Ideally, in order to be able to efficiently clean the nozzle plates without risking to damage them, the cleaning bar should operate—for example applying a suction—at a very short distance from the nozzles themselves, however without ever contacting them.

On industrial printing devices, typically equipped with several printing modules that follow each other along a considerable distance, the remarkable extension of the cleaning bar determines a substantial deflection thereof. The positioning accuracy, mostly at the maximum camber, is then seriously compromised and does not allow the above-mentioned optimum results to be obtained.

Cleaning apparatuses for printing devices according to the prior art are disclosed in US 2012/299996 A1, US 2018/264826 A1 and U.S. Pat. No. 9,227,412 B1.

Therefore, the technical problem underlying the present invention is to solve this drawback, namely to provide a digital printing device that ensures an efficient automatic nozzle plate's cleaning without resorting to an excessive construction complexity.

SUMMARY OF THE INVENTION

The above-identified technical problem is solved by a digital printing device, comprising:

a fixed frame;

a support portion;

a plurality of printing modules that are integral with said support portion and equipped with at least one print head, whose nozzle plate faces, in use, a printing area underlying the printing module;

wherein said digital printing device is arranged to print onto a printing medium that is relatively movable with respect to the fixed frame through said printing area in an advancement direction;

wherein said printing modules follow each other along a longitudinal direction that is parallel to said advancement direction;

said digital printing device comprising a cleaning bar, extended in a longitudinal direction, spanning below the plurality of said printing modules and translationally movable in a transverse horizontal direction that is orthogonal to the longitudinal direction;

said cleaning bar comprising a bar body that supports a plurality of cleaning heads, each of them being arranged to clean the nozzle plate of a specific printing module;

wherein said cleaning heads are supported in a floating manner by the bar body, so as to adapt their own height to the one of the overlying printing module.

Due to the floating positioning of the cleaning heads, the aim of an automatic levelling that makes up for the possible deflection of the bar at the specific nozzle plate is thus reached, ensuring that a predefined distance is kept between an operating portion of the cleaning head and the nozzle plate itself.

Preferably, the device comprises elastic means acting on each of said cleaning heads to keep them in contact with the overlying printing module.

Still preferably, at least two distinct elastic means act on each of said cleaning heads, at two application points separated from each other, so as to be able to perform an alignment of the head with the overlying module.

Where said cleaning heads have a prevalent extension in the longitudinal direction, said application points of the elastic means can be advantageously spaced along the above longitudinal direction.

In a preferred embodiment, the elastic means are compression springs interposed between said bar body and a stop surface of said cleaning heads.

Each cleaning head can comprise at least one eyelet fit into a vertical pin that is integral with the bar body or, vice versa, said bar body can comprise an eyelet fit into a vertical pin that is integral with the cleaning head, said compression springs being placed around said pins.

Each cleaning head can comprise, at the opposed ends, two eyelets fit into respective vertical pins that are integral with the bar body or, vice versa, each cleaning head can provide at the opposed ends two vertical pins fit into respective eyelets of the bar body.

Each cleaning head, as outlined above, can comprise at the top an operating portion intended to face, in use, the nozzle plate.

Preferably, said operating portion is arranged to keep at a predefined distance from the nozzle plate, without ever contacting it.

Said operating portion is preferably a suction opening connected to suction means, still preferably a suction slot extended in the longitudinal direction.

Said cleaning head can have in fact a box-like body in fluid communication with a suction manifold that is integral with the bar body.

Each cleaning head can further comprise at the top at least one contour follower—for example in the form of a roller— intended to contact a respective lower surface of the printing module, said lower surface being distinct from the nozzle plate.

Preferably, each cleaning head comprises two contour followers located at the opposed ends of the above operating portion.

Further features and advantages will become more apparent from the following detailed description of a preferred, but not exclusive, embodiment of the present invention, with reference to the enclosed figures given by way of non-limiting example.

DETAILED DESCRIPTION

Figure 1:
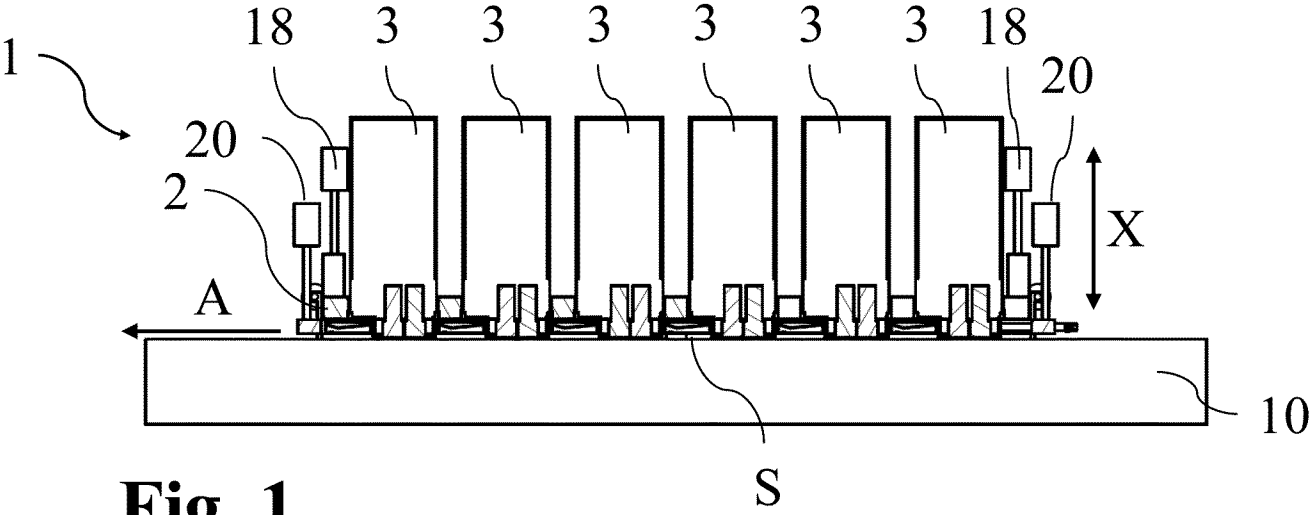
FIG. 1 shows a suitably-simplified side sectional view of a digital printing device according to the present invention in a printing configuration.

With reference to the attached FIGS. 1-10, a digital printing device according to the present invention is globally identified with 1.

This digital printing device 1 is schematically illustrated in the above figures, with omission of some construction elements known per se such as the upper and lower cases and graphic simplification of the represented elements.

Hereafter in the description, terms like above, below, lower, upper, or derivatives thereof are to be understood with reference to the normal configuration of use of the digital printing device 1 illustrated in the aforesaid figures.

With reference to the configuration of use of the digital printing device 1 three orthogonal directions are further defined: a first direction or vertical direction X; a second direction or longitudinal direction Y that is parallel to the advancement direction A of a printing medium during printing operations; finally a third direction or transverse direction Z that is orthogonal to the first two.

The digital printing device 1 comprises in a known manner a fixed frame 10, that the figures represent in a simplified manner as a parallelepiped base.

On said fixed frame 10 a printing area S is defined, that is represented in the preferred embodiment by a planar path along which an unrepresented printing medium is moved forward—along the above-defined advancement direction A—through advancement means known per se.

The digital printing device comprises a plurality of printing modules 3, supported in an overhanging manner above the printing area S by a support portion 2. the printing modules 3 follow each other along the longitudinal direction Y, and they are substantially juxtaposed to each other.

Each printing module 3 has a lower portion 17 that expands close to the printing area S and that houses one or more print heads 4. These print heads 4 are naturally turned with the nozzles towards the printing area; the operating surface of the nozzles is identified hereinafter as the nozzle plate 5.

The support portion 2, due to a first linear actuating means 18 of a known type, is translatable along the vertical direction X with respect to the main frame 10 of the machine.

In particular, as it will better appear from the following description, the support portion 2 can take at least three different positions, that correspond to three different heights of the nozzle 5 surfaces above the printing area S: a totally lowered position; an intermediate position; and a totally raised position.

The digital printing device 1 further comprises, for each printing module 3, a corresponding collection member 6 whose function will better appear hereafter in the present description.

The collection members 6 have a prevalent linear expansion along the transverse direction Z, and they are jointed to each other by two side longitudinal members that connect the ends thereof so as to define a grid assembly 11.

The single collection member 6 has at the top two hopper-like sloping flaps 15 that define a collection tank 8, on whose bottom a plurality of drain openings 14 in the form of equally-spaced holes open, that communicate with a suction chamber 12 inside the element and extended along the whole axial expansion thereof.

The collection tank 8 is overlapped by an embossed peripheral edge 16, having a rectangular geometry.

The lower face of the collection member 6 is instead flat, traversed by a suction opening 7 that puts it in communication with said suction chamber 12.

The suction opening 7 is preferably configured as a continuous slot that runs along the whole body of the collection member 6, in a transverse direction.

A projecting flap 13 is suitably arranged on the intrados of the suction opening 7, that allows the leakage of liquid coming from the suction chamber 12 to be avoided.

It is worth noting that the collection member 6 has an asymmetric transverse profile; in fact both the suction opening 7 and the convergence of the flaps 15 of the collection tank 8 do not lie along the profile midline, but they are offset upstream with respect to the advancement direction A of the printing medium.

The different suction chambers 12 of the assembly 11 lead all into a common suction manifold, that is connected in turn to a vacuum source.

The whole assembly 11 is laterally supported by horizontal guides, and it is movable with respect to the fixed frame 10. In particular, both second linear actuating means 19, that allow the translation back and forth along the longitudinal direction Y, and third linear actuating means 20, that allow instead the raising and lowering along the vertical direction X are provided.

A cleaning bar 9, that linearly expands below the printing modules 3 along the whole longitudinal direction Y, is associated with the above-described support portion 2. In other words, the cleaning bar 9 extends below the printing modules 3 transversely thereto.

Said cleaning bar 9 is mounted at the two opposed ends thereof on lines 21 that are integral with the support portion 2 and it is therefore able to translate, by the action of fourth linear actuating means 29, along the transverse direction Z below the printing modules 3.

The cleaning bar 9 is usually in a rear limit stop position in which it interferes neither with the plane that defines the printing area S, nor with the assembly 11 of the collection members 6. Only when the support portion 2 is in a raised position and the collection assembly 6 is not just below the printing modules 3, the cleaning bar 9 can freely slide below these printing modules 3 without mechanically interfering with the two above elements.

The cleaning bar 9 comprises a plurality of cleaning heads 22, each of them is arranged to clean the nozzle plate 5 of a specific printing module 3.

The cleaning heads 22 are mounted in a floating manner with respect to a fixed bar body 23, namely they are able to adapt their height to the one of the overlying printing module 3.

Actually, the single cleaning head 22 is a box-like element equipped with side eyelets 25 into which two pins 24, that are integral with the bar body 23, are introduced. A compression spring 26, that pushes the cleaning head 22 upwards, is fit around the pin 24, between the bar body 23 and the side eyelet 25. At the top, the cleaning head has two side rollers 27, serving as contour followers, that keep in contact with respective tracks made below the printing module 3, on each side of the nozzle plate 5.

The cleaning head 22 has at the top, between the two side rollers 27, a cusp-like portion culminating with a suction slot 28. The cleaning head 22 is in fluid communication with a suction manifold that runs along the bar body 23, said manifold being connected in turn to a vacuum source.

Due to the floating structure with spring and contour followers, the cleaning head 22 keeps at a predetermined distance from the printing module 3 overhanging it, and in particular the suction slot 28 is positioned at a short distance below the nozzle plate 5, and it can carry out its suction action thereon without any risk of contact that could damage the nozzles themselves.

The assembly 11 that bears the collection members 6 and the support portion 2 that supports the printing modules 3 can take different mutual positions, corresponding to the configurations described hereinafter.

Figure 2:
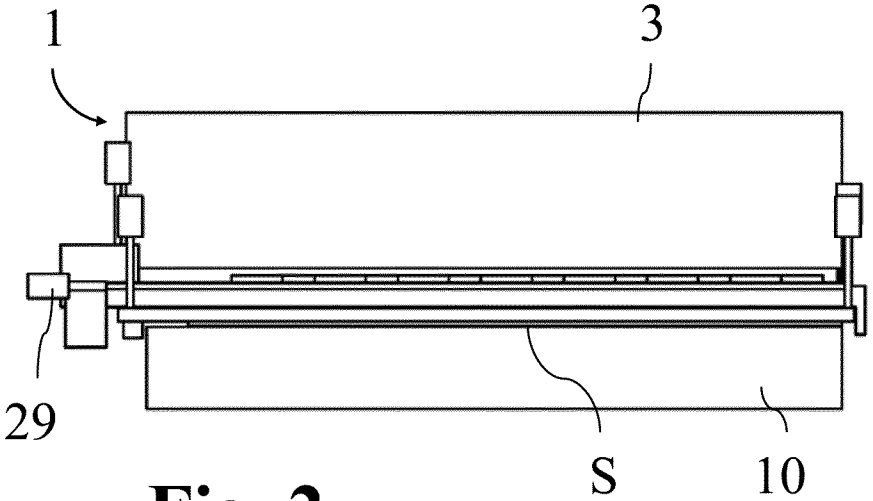
FIG. 2 shows a front view of the digital printing device in the configuration of FIG. 1.
Figure 3:
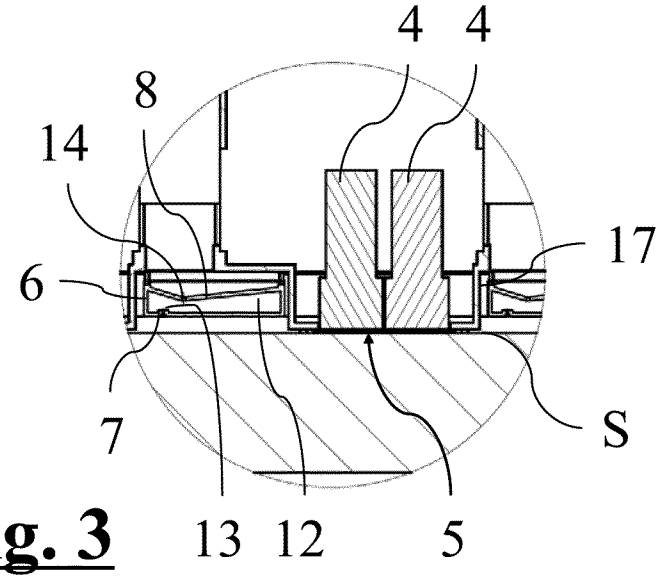
FIG. 3 shows an enlarged detail of FIG. 1.

In a printing configuration, illustrated in the enclosed FIGS. 1-3, the support portion 2 is in a totally lowered position and the collection members 6 are offset with respect to the lower portions 17 of the printing modules 3.

In this configuration, the collection members 6 fit into appropriate recesses obtained between the subsequent lower portions 17 of the printing modules 3. The nozzle 5 surfaces open next to the printing area S, as well as the suction openings 7 of the collection members 6.

This configuration allows the printing onto a printing medium to be performed, wherein the suction openings 7 provide to remove the excess ink in the passage between a print head 4 and the subsequent one.

Figure 4:
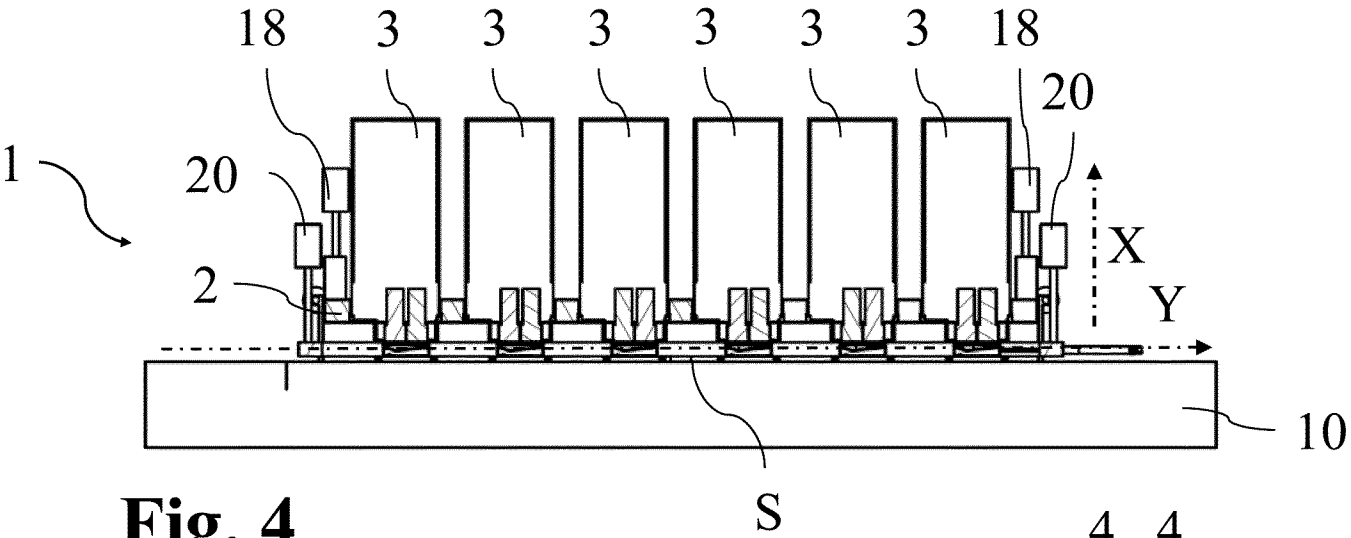
FIG. 4 shows a suitably-simplified side sectional view of the digital printing device of FIG. 1 in a rest configuration.
Figure 6:
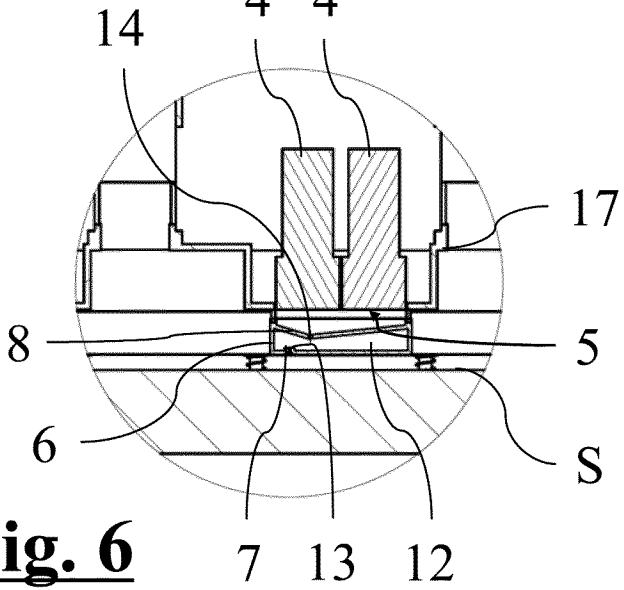
FIG. 6 shows an enlarged detail of FIG. 4.
Figure 5:
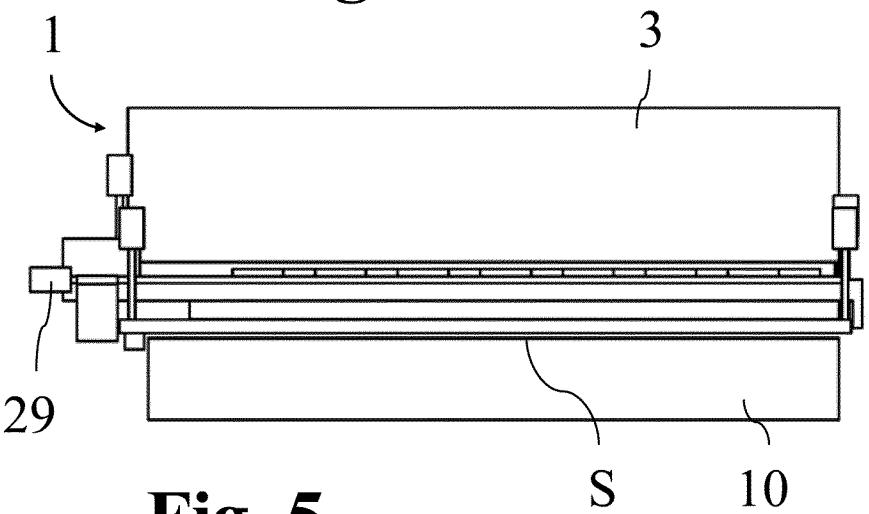
FIG. 5 shows a front view of the digital printing device in the configuration of FIG. 4.
Figure 7:
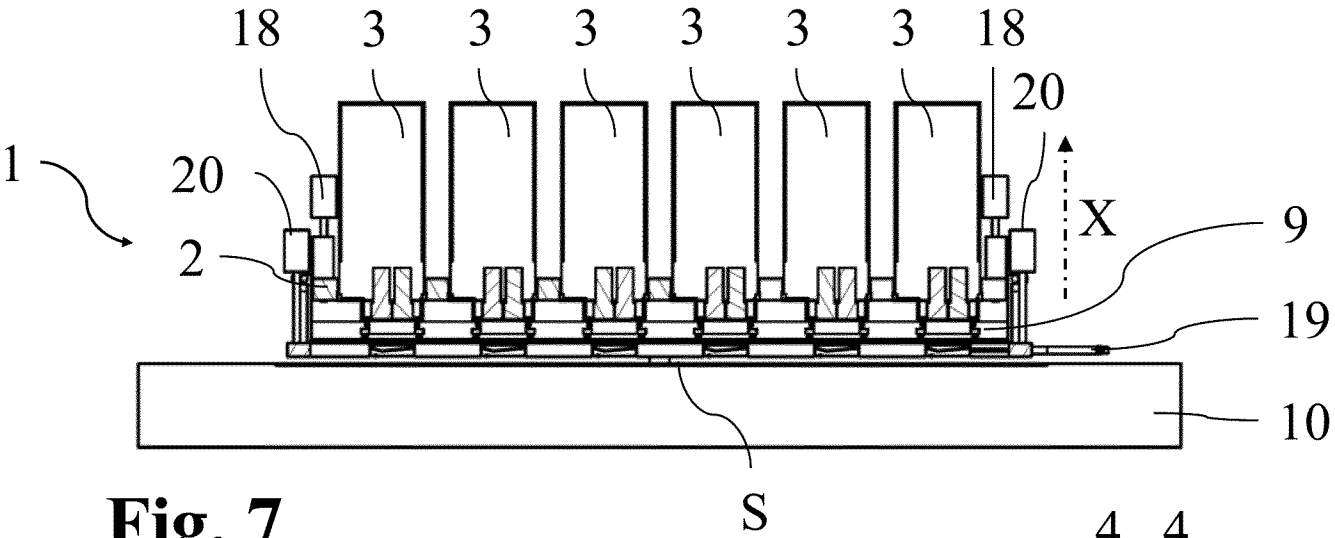
FIG. 7 shows a suitably-simplified side sectional view of the digital printing device of FIG. 1 in a cleaning configuration.
Figure 8:
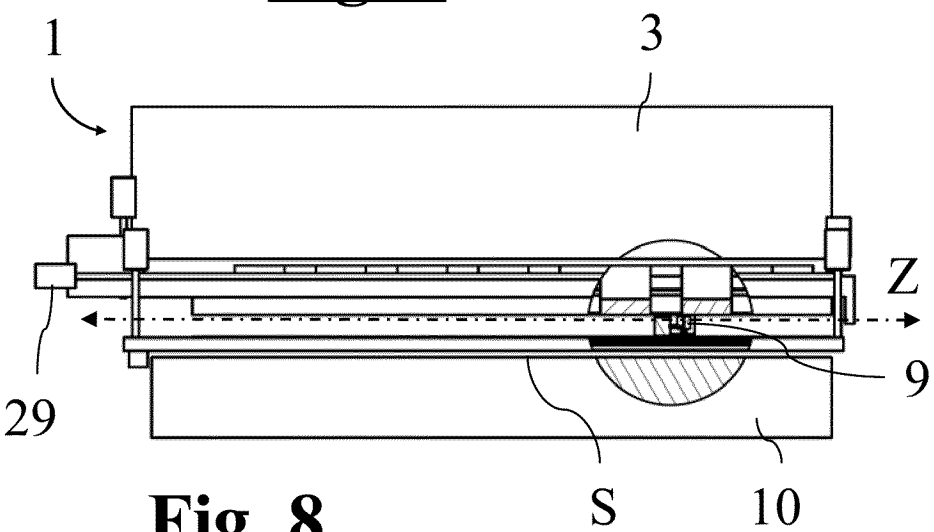
FIG. 8 shows a front view of the digital printing device in the configuration of FIG. 7.
Figure 9:
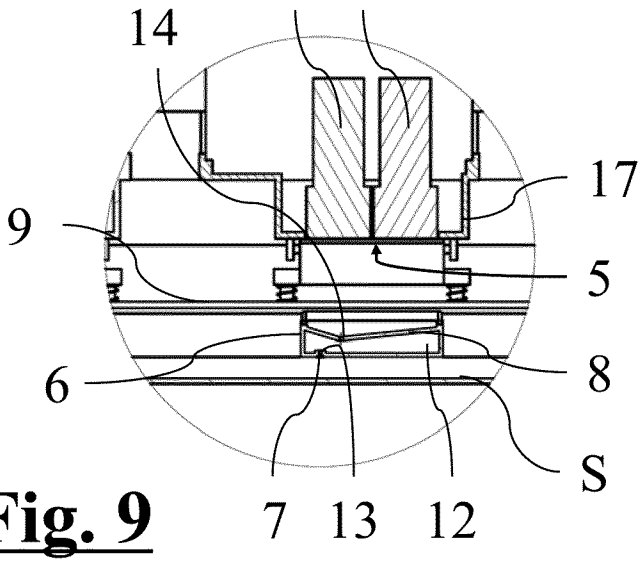
FIG. 9 shows an enlarged detail of FIG. 7.
Figure 10:
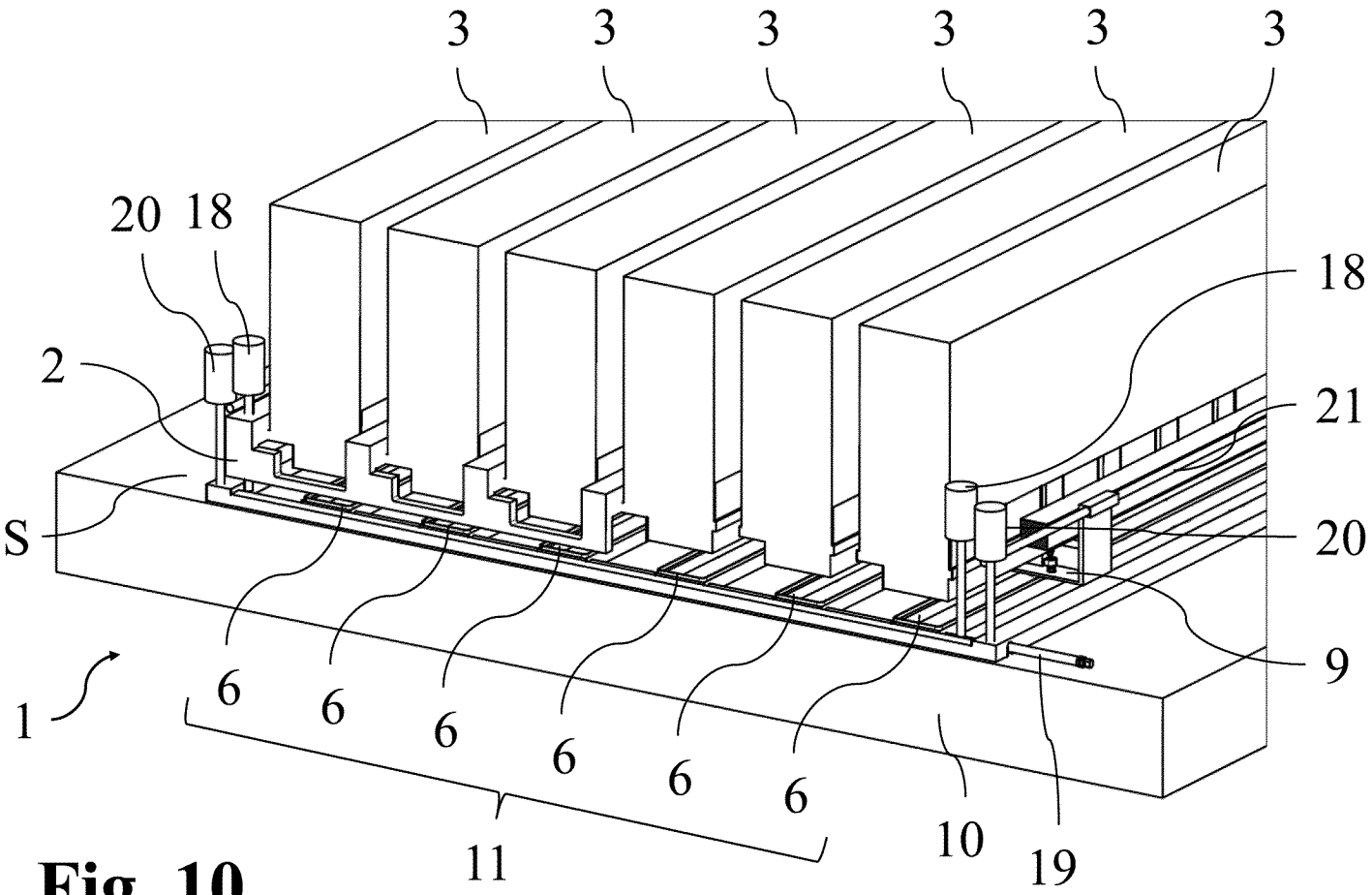
FIG. 10 shows a perspective view of the digital printing device in the configuration of FIG. 7.
Figure 11:
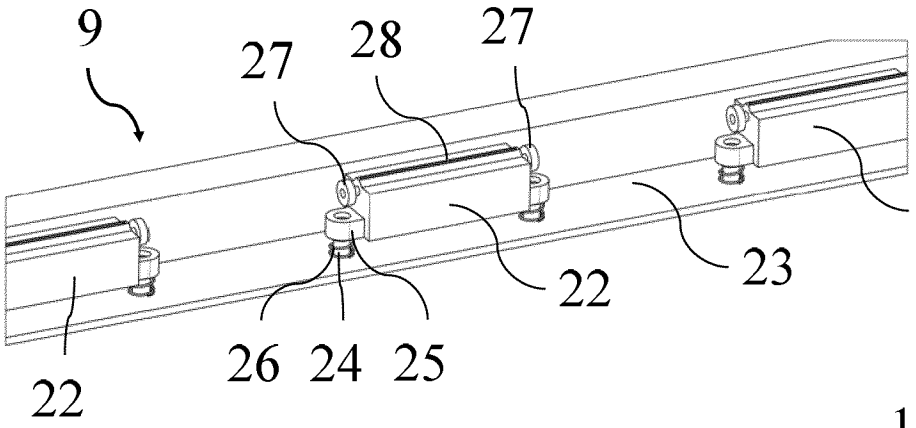
FIG. 11 shows a perspective view of an enlarged detail of a cleaning bar of the digital printing device of FIG. 1.
Figure 12:
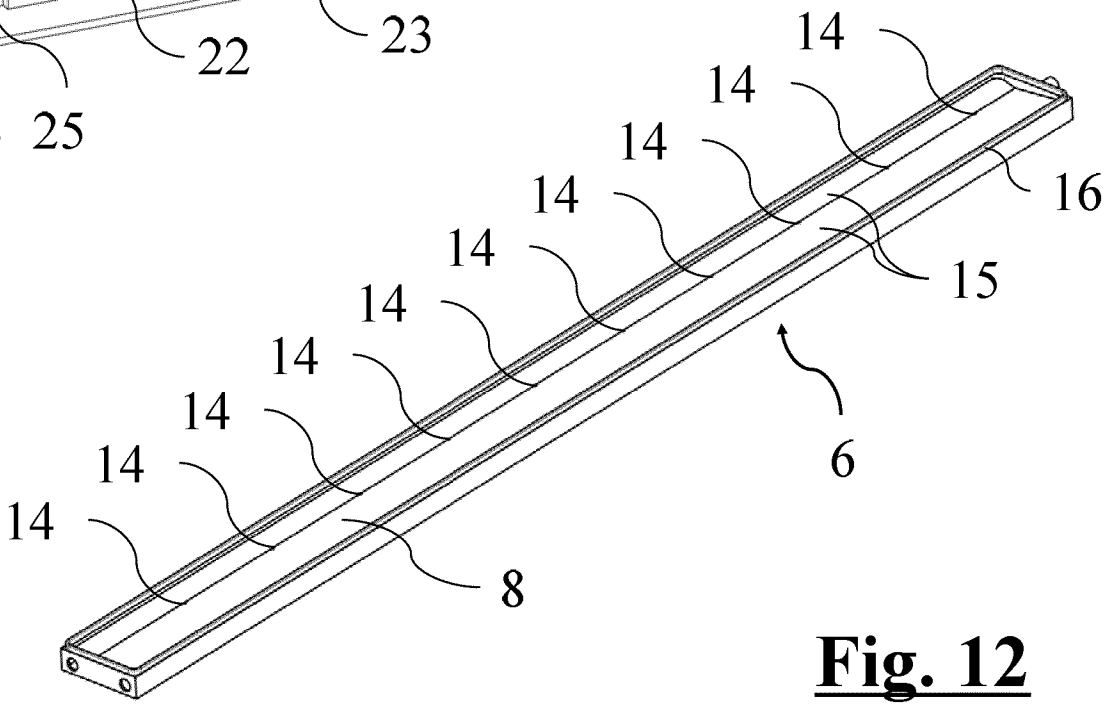
FIG. 12 shows a perspective view of a collection member of the digital printing device of FIG. 1.

In a rest configuration, illustrated in the enclosed FIGS. 4-6, the support portion 2 is in an intermediate position and the collection members 6 are aligned with respect to the lower portions 17 of the printing modules 3.

In this configuration, the peripheral edge 16 of the collection member 6 abuts against a neighbourhood of the nozzle plate 5, so that the collection tank defines a protection lid of the respective printing module 3.

A controlled-humidity atmosphere is achieved inside this protection lid, so as to avoid any risk of ink drying.

In a cleaning configuration, illustrated in the enclosed FIGS. 7-10, the support portion 2 is in a totally raised position and the collection members 6 are aligned with respect to the lower portions 17 of the printing modules 3.

In this configuration, the printing modules 3 are at some distance from the collection members 6, allowing the passage of the cleaning bar 9 in the transverse direction Z. The cleaning of the nozzle plate 5 can thus be achieved. In operation, a positive pressure, that defines an ink purge, is imposed on the print heads 4; the suction of the cleaning heads 22 thus creates a vortex with a cleaning action on the nozzles.

The collection tanks 8 are in this case suitably positioned below the nozzle 5 surfaces during cleaning operations, and they can thus collect the dropping ink.

Obviously, in order to meet contingent and specific requirements, a person skilled in the art will be allowed to bring several changes and modifications to the above-described invention, all however contained in the scope of protection of the invention as defined by the following claims.

What is claimed is:

1. A digital printing device, comprising:

a fixed frame;

a support portion;

a plurality of printing modules that are integral with said support portion and equipped with at least one print head, whose nozzle plate faces, in use, a printing area underlying the plurality of printing modules;

wherein said digital printing device is arranged to print onto a printing medium that is relatively movable with respect to the fixed frame through said printing area in an advancement direction;

wherein said plurality of printing modules follow each other along a longitudinal direction that is parallel to said advancement direction;

said digital printing device comprising a cleaning bar, extended in the longitudinal direction, spanning below said plurality of printing modules and translationally movable in a transverse horizontal direction that is orthogonal to the longitudinal direction;

said cleaning bar comprising a bar body that supports a plurality of cleaning heads, each of them being arranged to clean the nozzle plate of a specific printing module of said plurality of printing modules;

wherein said plurality of cleaning heads are supported in a floating manner by the bar body, so as to adapt their own height to an overlying printing module of said plurality of printing modules.

2. The digital printing device according to claim 1, comprising elastic members acting on each of said plurality of cleaning heads to keep them in contact with said overlying printing module of said plurality of printing modules.

3. The digital printing device according to claim 2, wherein at least two distinct elastic members act on each of said plurality of cleaning heads, at two application points separated from each other.

4. The digital printing device according to claim 3, wherein each of said plurality of cleaning heads has a prevalent extension in the longitudinal direction, said application points of the elastic members being spaced along said longitudinal direction.

5. The digital printing device according to claim 4, wherein each cleaning head of said plurality of cleaning heads comprises, at the opposed ends, two eyelets fit into respective vertical pins that are integral with the bar body or, vice versa, each cleaning head of said plurality of cleaning heads provides at the opposed ends two vertical pins fit into respective eyelets of the bar body; said compression springs being placed around said pins.

6. The digital printing device according to claim 2, wherein said elastic members are compression springs interposed between said bar body and a stop surface of each of said plurality of cleaning heads.

7. The digital printing device according to claim 6, wherein each of said plurality of cleaning heads comprises at least one eyelet fit into a vertical pin that is integral with the bar body or, vice versa, said bar body comprises an eyelet fit into a vertical pin that is integral with each of said plurality of cleaning heads, said compression springs being placed around said pins.

8. The digital printing device according to claim 1, wherein each cleaning head of said plurality of cleaning heads comprises at the top an operating portion intended to face, in use, the nozzle plate.

9. The digital printing device according to claim 8, wherein said operating portion is a suction opening connected to a suction device.

10. The digital printing device according to claim 9, wherein said operating portion is a suction slot extended in the longitudinal direction.

11. The digital printing device according to claim 9, wherein each cleaning head of said plurality of cleaning heads has a box-like body in fluid communication with a suction manifold that is integral with the bar body.

12. The digital printing device according to claim 8, wherein each cleaning head of said plurality of cleaning heads comprises at the top at least one contour follower intended to contact a respective lower surface of said overlying printing module of said plurality of printing modules, said lower surface being distinct from the nozzle plate; and wherein each cleaning head of said plurality of cleaning heads comprises two contour followers located at the opposed ends of said operating portion.

13. The digital printing device according to claim 1, wherein each cleaning head of said plurality of cleaning heads comprises at the top at least one contour follower intended to contact a respective lower surface of said overlying printing module of said plurality of printing modules, said lower surface being distinct from the nozzle plate.

14. The digital printing device according to claim 13, wherein said at least one contour follower is a roller.

* * * * *